US009340401B2

(12) United States Patent
Takeuchi et al.

(10) Patent No.: US 9,340,401 B2
(45) Date of Patent: May 17, 2016

(54) HEAVY OBJECT CASSETTE TRANSFERRING APPARATUS AND A TRANSFERRING METHOD THEREOF

(75) Inventors: Yukio Takeuchi, Tokyo (JP); Satoru Nooka, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 954 days.

(21) Appl. No.: 13/519,677

(22) PCT Filed: Feb. 25, 2010

(86) PCT No.: PCT/JP2010/052993
§ 371 (c)(1),
(2), (4) Date: Jul. 6, 2012

(87) PCT Pub. No.: WO2011/104851
PCT Pub. Date: Sep. 1, 2011

(65) Prior Publication Data
US 2012/0263564 A1 Oct. 18, 2012

(51) Int. Cl.
*B66F 9/12* (2006.01)
*B66F 9/18* (2006.01)
*B66F 9/06* (2006.01)

(52) U.S. Cl.
CPC . *B66F 9/18* (2013.01); *B66F 9/185* (2013.01); *B66F 9/06* (2013.01)

(58) Field of Classification Search
CPC ..... B60B 2340/34; B60B 2340/36; B60B 2340/52; B60B 30/08; B60B 30/10; B66F 9/00; B66F 9/14; B66F 9/06; B66F 9/18; B66F 9/185; B62B 3/00; B62B 3/06
USPC ..... 414/664, 684, 667, 668, 671, 607, 621, 414/740, 741
See application file for complete search history.

(56) References Cited

U.S. PATENT DOCUMENTS 3,143,233 A * 8/1964 Evans et al. ..... 414/620
3,491,427 A * 1/1970 Zimmerman et al. ..... 29/240
(Continued)

FOREIGN PATENT DOCUMENTS

DE 100 00 201 7/2001
JP 49-43808 11/1974
(Continued)

OTHER PUBLICATIONS

International Preliminary Report on Patentability and Written Opinion of the International Searching Authority issued Sep. 18, 2012 in corresponding International Application No. PCT/JP2010/052993 (with English translation).
(Continued)

*Primary Examiner* — Saul Rodriguez
*Assistant Examiner* — Mark Hageman
(74) *Attorney, Agent, or Firm* — Wenderoth, Lind & Ponack, L.L.P.

(57) ABSTRACT

A transferring apparatus is provided with a heavy object cassette which is a heavy object contained in a cassette integrally, a common steel plate to which support rods are fixed, the support rods being inserted in holes formed horizontally in the heavy object cassette, and a play mechanism which allows adjustment of a relative position between the holes and the support rods by adjusting a position of the common steel plate, a base unit having thereon the play mechanism and a lifting and lowering device, and a slide mechanism which supports the base unit and is movable forward and backward relative to a main body of the transferring apparatus.

7 Claims, 6 Drawing Sheets

(56) References Cited

U.S. PATENT DOCUMENTS

| | | | | |
|---|---|---|---|---|
| 3,593,672 | A * | 7/1971 | Breen et al. | 410/129 |
| 3,908,845 | A * | 9/1975 | Bolt | 414/746.5 |
| 4,056,207 | A * | 11/1977 | Spilker | 414/620 |
| 4,925,357 | A * | 5/1990 | Cisternino et al. | 414/495 |
| 5,269,501 | A * | 12/1993 | Liegel et al. | 269/17 |
| 5,378,004 | A * | 1/1995 | Gunlock et al. | 280/47.2 |
| 5,464,314 | A * | 11/1995 | Laaksonen | 414/427 |
| 5,618,228 | A * | 4/1997 | Anderson | 451/403 |
| 6,969,225 | B2 * | 11/2005 | Mensch | 414/685 |
| 7,611,126 | B2 * | 11/2009 | Vesa | 254/93 H |
| 2009/0020934 | A1 * | 1/2009 | Metcalf et al. | 269/77 |
| 2013/0223962 | A1 * | 8/2013 | Ellington et al. | 414/495 |

FOREIGN PATENT DOCUMENTS

| | | |
|---|---|---|
| JP | 5-106127 | 4/1993 |
| JP | 6-191691 | 7/1994 |
| JP | 9-40394 | 2/1997 |
| JP | 9-67003 | 3/1997 |
| JP | 2005-231748 | 9/2005 |
| JP | 2009-84016 | 4/2009 |
| NL | 1002428 | 8/1997 |
| TW | 521059 | 2/2003 |

OTHER PUBLICATIONS

Decision to grant a patent issued May 29, 2014 in corresponding Japanese Application No. 2012-501582 (with English translation).

Office Action issued Aug. 29, 2013 2013 in corresponding Japanese Application No. 2012-501582 (with English tranlsation).

Decision to grant a European patent pursuant to Article 97(1) EPC issued Jul. 3, 2014 in corresponding European Application No. 10846516.2.

International Search Report issued Aug. 17, 2010 in corresponding International Application No. PCT/JP2010/052993.

Approval Decision Letter issued May 29, 2013 in corresponding Taiwanese Application No. 099105720 (with English translation).

Extended European Search Report issued Jun. 21, 2013 in corresponding European Application No. 10846516.2.

* cited by examiner

HEAVY OBJECT CASSETTE TRANSFERRING APPARATUS AND A TRANSFERRING METHOD THEREOF

TECHNICAL FIELD

The present invention relates to an apparatus and a device for transferring a heavy object cassette formed by winding a belt-shaped material around a drum-shaped member, in which a plurality of support rods are, respectively, inserted in a plurality of holes formed in the heavy object cassette so as to hold the heavy object cassette via the support rods.

BACKGROUND ART

FIG. 6A shows one example of a heavy object cassette transferring device in relation to the related art, where a heavy object weighing approximately 100 kg is unloaded from a table after winding a belt-shaped material around a drum-shaped member and then moved onto a transferring cart.

FIG. 6A shows an arm 052 fixed to an end of a support 051 installed upright on the ground 101, and a wire winch 055, 054, 056 provided at an end of the arm 052 via a hinge mechanism 053. To a lower part 056 of the wire winch, a slide mechanism is connected. To the slide mechanism 057, a carrying unit 060 is installed movable in a horizontal direction.

In the carrying unit 060, three support rods 058, 058, 059 are installed horizontally. The bottom support rod 059 functions as a stopper to prevent the heavy object cassette from falling after the support rods 058, 058 are inserted in holes formed in the heavy object cassette 060. The slide mechanism 057 has a leg 057*a* which is movable horizontally (in a range indicated with S). When the heavy object cassette 060 is picked up, the leg 057*a* moves leftward in the drawing to return to its original position so as to keep balance.

Further, in Patent Literature 1 (JP5-106127A) disclosed is an apparatus for automatically mounting a cake in which a cake mount supporting a winded cake having a yarn winded around is positioned in advanced at a prescribed position of a corresponding twisting machine and by controlling a robot body by the apparatus, the winded cake supported on the cake mount is removed and mounted automatically on a creel successively.

CITATION LIST

Patent Literature

[Patent Literature 1]
JP 5-106127 A

Technical Problem

In the transferring apparatus of FIG. 6, the wire winch 055, 054, 056 is provided at the end of the arm 052 and by hoisting and lowering the wire winch, the carrying unit 060, three support rods 058, 058, 059 and the heavy object cassette 060 are integrally hoisted and lowered. Thus, the lifting and lowering the heavy object cassette 060 is slow and inefficient.

Further, the support 051 is installed on the ground 101 and the transferring apparatus for the heavy object is fixed on the ground. Thus, it is extremely difficult to change the layout and the range of movement is small.

Furthermore, in the transferring apparatus of FIG. 6, the operation of the apparatus requires many adjustments such as balancing the heavy object cassette 060 horizontally and adjusting the movable range S of the slide mechanism 057 and it takes time to get used to the operation, resulting in poor operation efficiency.

The use of the oil pressure for the slide mechanism 057 and so on, causes issues such as frequent failures by oil leaks.

Further, the apparatus disclosed in Patent Literature 1 (JP5-106127A) is for automatically mounting the cake. This literature merely discloses how to position the cake mount supporting the winded cake at the prescribed position of the corresponding twisting machine.

SUMMARY OF INVENTION

In view of the above issues of the related art, it is an object of the present invention to provide a transferring apparatus for a heavy object cassette as well as a transferring method for the heavy object cassette, which is mainly operable mechanically without using hydraulic pressure, by which it is easy to load the heavy object cassette and an operation speed is improved.

Solution to Problem

To achieve the object of the present invention, the present invention provides a transferring apparatus for a heavy object cassette, which may include, but is not limited to:

a common plate member to which a plurality of support rods are attached on a support side of the support rods, the plurality of support rods being inserted in a plurality of holes formed in the heavy object cassette;

a play mechanism which allows adjustment of a relative position between the plurality of holes and the plurality of support rods by adjusting a position of the common plate member;

a lifting and lowering device which lifts and lowers the common plate member to which the support rods are attached and the play mechanism;

a base unit on which the lifting and lowering device is installed; and a slide mechanism which supports the base unit movable forward and backward relative to a main body of the transferring apparatus.

According to the present invention, the position of the common plate member can be adjusted by the play mechanism, hence eliminating the need for fine-adjustment of the positions of the support rods and the holes. This makes it easy to insert the support rods in the holes.

More specifically, the support rods are attached to the common plate member on the support side of the support rods and the common plate member is supported by the play mechanism with entire motion freedom in the rotation direction and the up-down and left-right directions. Thus, the position relationship of the support rods is fixed to match the holes and the fine-adjustment between the support rods and the holes is performed by the play mechanism of the plate member. This makes it easy to insert the support rods in the holes. If the support rods are individually adjustable, it takes extra process for performing the fine-adjustment between the support rods and the holes, resulting in complicating the operation.

As described above, according to the present invention, inserting the support rods in the heavy object cassette is easier and the operation speed of the transferring apparatus for the heavy object cassette is improved, thereby improving the efficiency of the process.

Further, the lifting and lowering device is provided to lift and lower the common plate member to which the support rods are attached and the play mechanism, and the base unit is supported by the slide mechanism movable forward and backward relative to the main body of the transferring apparatus. Thus, it is possible to reduce the overall length and the size of the transferring apparatus for the heavy object cassette.

More specifically, the heavy object cassette is grabbed at an anterior end position of the main body of the transferring apparatus using the slide mechanism, the base unit is moved to the center part of the main body of the transferring apparatus via the slide mechanism to balance and then, the main body of the transferring apparatus is moved via the wheels with a steady balance. Therefore, the transferring apparatus can be moved in a steady and safe manner without increasing the overall length of the transferring apparatus. By this, it is also possible to reduce the size of the transferring apparatus as well as its overall lengths.

In the above transferring apparatus for the heavy object cassette, at least one of the support rods may penetrate the common plate member and may be an eccentric support rod formed with a certain amount of eccentricity with respect to the common plate member, and the transferring apparatus may further include:

a cassette immobilizing mechanism which immobilizes the heavy object cassette by rotating an eccentric part of the eccentric support rod to move the eccentric support rod in a radial direction and changing a relative position between the eccentric support rod and other support rods.

By providing the cassette immobilizing mechanism, the weight of the heavy object cassette can be supported by the rigid plate member by inserting the support rods in the holes formed horizontally in the heavy object cassette and the heavy object cassette can be picked and immobilized by the support rods so as to prevent the heavy object cassette from falling out of the support rods.

In this manner, the weight of the heavy object cassette is supported by the plurality of support rods fixed horizontally to the common plate member the weight of the heavy object cassette can be mechanically supported directly by the support rods so as to be movable in the horizontal direction without using the wire winch of the related art.

By this, the heavy object cassette which is substantially heavy can be supported easily and highly efficiently and without using the hydraulic pressure, there is no issue such as oil leaks.

Further, in the above transferring apparatus for the heavy object cassette, one support rod disposed in the lowest position among the support rods may penetrate the common plate member and may be an eccentric support rod formed with a certain amount of eccentricity with respect to the common plate member.

In this manner, the lowest support rod disposed in the lowest position among the support rods penetrates the common plate member and is the eccentric support rod formed with a certain amount of eccentricity with respect to the common plate member. Other support rods disposed above the eccentric support rod are used to lift the heavy object cassette and no support load is acting on the lowest support rod disposed in the lowest position and thus, the lowest support rod can be turned with small turning force compared to the other support rods disposed above the lowest support rod. Therefore, by simply turning the eccentric support rod which is the lowest support rod, the position of the eccentric support rod can be change in the radial direction. By this, a relative distance of the support rods changes relative to a relative distance of the holes formed in the heavy object cassette. Further, the heavy object cassette can be easily immobilized by grabbing the cassette by the support rods or holding the cassette firmly by the support rods in the case of expanding the relative distance of the support rods.

The support rods are, for instance, three support rods arranged circumferentially and one of the support rods is the eccentric support rod disposed at the lowest position among three support rods. In this manner, it is most practical to constitute the eccentric support rod of the support rod disposed at the lowest position among three support rods, as this requires fewer support rods and the cassette immobilizing mechanism is reliable and thus, this combination is most practical.

The above transferring apparatus for the heavy object cassette, may further include:

a locking mechanism which activates a brake on the main body of the transferring apparatus when a gate-type support is moved from a center part of the main body of the transferring apparatus by the slide mechanism.

In this manner, the main body of the transferring apparatus can be locked by the locking mechanism and thus, the insertion of the support rods in the holes of the heavy object cassette and also the lowering of the heavy object cassette from the placement table can be performed in a steady manner. By this, the above process can be performed positively and promptly.

Further, the locking mechanism may be activated when the lifting and lowering device lifts the gate-type support to a certain height or higher. By this, the main body of the transferring apparatus can be moved when the lifting and lowering device is at the central part of the main boy and at the certain height or lower. Thus, the main body of the transferring apparatus can be moved only in such a state that the balance is steady, thereby achieving the steady transferring while preventing it from falling.

The present invention also provides a method for transferring a heavy object cassette using a heavy-object-cassette transferring apparatus which transfers the heavy object cassette by rolling motion of a wheel while maintaining the heavy object cassette via a plurality of support rods inserted in a plurality of holes formed in the heavy object cassette, the method including, but not limited to, the steps of:

inserting the plurality of support rods fixed to a common plate member in the plurality of holes formed in the heavy object cassette;

in the inserting step, adjusting a relative position between the plurality of holes and the plurality of support rods by adjusting a position of the common plate member;

immobilizing the support rods having been inserted in the holes, with respect to the plurality of holes; and after the immobilizing step, moving the heavy object cassette using a slide mechanism.

According to the present invention, the sequence of the inserting the support rods in the holes, adjusting the plate member in the inserting step, immobilizing the cassette after inserting and moving the heavy object cassette can be continuously performed by combining the following steps:

inserting the plurality of support rods in the plurality of holes formed in the heavy object cassette;

in the inserting step, adjusting the position of the support rods via the plate member;

immobilizing the support rods having been inserted in the holes, with respect to the plurality of holes; and after the immobilizing step, moving the heavy object cassette using the slide mechanism, it is possible to achieve the effects listed below.

As a result, the heavy object cassette can be moved positively and efficiently.

Furthermore, in the above method for transferring the heavy object cassette, in the immobilizing step, one of the support rods which penetrates the common plate member and which is an eccentric support rod formed with a certain amount of eccentricity, may be rotated so that the eccentric support rod is moved in a radial direction of the eccentric support rod to displace the relative position between the eccentric support rod and other support rods.

In this manner, by rotating the eccentric support rod, the eccentric support rod is moved in the radial direction of the eccentric support rod, thereby displacing the relative position between the eccentric support rod and other support rods. Therefore, the heavy object cassette can be picked up by the support rods and be easily immobilized.

In the above method for transferring the heavy object cassette, a brake may be applied to a main body of the transferring apparatus when the support rods are inserted in the holes of the heavy object cassette using the slide mechanism or when the heavy object cassette is removed from a placement table for the heavy object cassette using the slide mechanism.

According to this method for transferring the heavy object cassette, the main body of the transferring apparatus can be locked by the locking mechanism and thus, the insertion of the support rods in the holes of the heavy object cassette and also the lowering of the heavy object cassette from the placement table can be performed in a steady manner. By this, the above process can be performed positively and promptly.

Advantageous Effects of Invention

According to the present invention, the position relationship of the support rods fixed to the common plate member is matched in advance with the position relationship of the holes formed in the heavy object cassette, and by adjusting the position of the common plate in the rotation direction and the up-down and left-right directions by the play mechanism, an absolute position relationship between the support rods and the holes is fixed, while the fine adjustment between the support rods and the holes is performed by adjusting the position of the plate member. By this, the operation of inserting the support rods in the holes is easier and the support rods can be easily mounted in the heavy object cassette, hence improving the operation speed and the efficiency of the transferring apparatus for the heavy object cassette.

Further, the base unit having thereon the common plate member to which the support rods are fixed on the support side, the play mechanism for adjusting the position of the plate member, and the lifting and lowering device for lifting and lowering the plate member and the play mechanism, is supported by the slide mechanism so as to be movable frontward and rearward relative to the main body of the transferring apparatus. Thus, the heavy object cassette can be transferred in a steady manner without increasing the overall length of the transferring apparatus for the heavy object cassette and thus, it is possible to reduce the overall length and the size of the transferring apparatus.

Furthermore, the weight of the heavy object cassette can be mechanically supported directly by the support rods so as to be movable in the horizontal direction without using the wire winch of the related art. By this, the heavy object cassette which is substantially heavy can be supported easily and highly efficiently and without using the hydraulic pressure, there is no issue such as oil leaks.

DESCRIPTION OF EMBODIMENTS

A preferred embodiment of the present invention will now be described in detail with reference to the accompanying drawings. It is intended, however, that unless particularly specified, dimensions, materials, shape, its relative positions and the like shall be interpreted as illustrative only and not limitative of the scope of the present invention.

Figure 1:
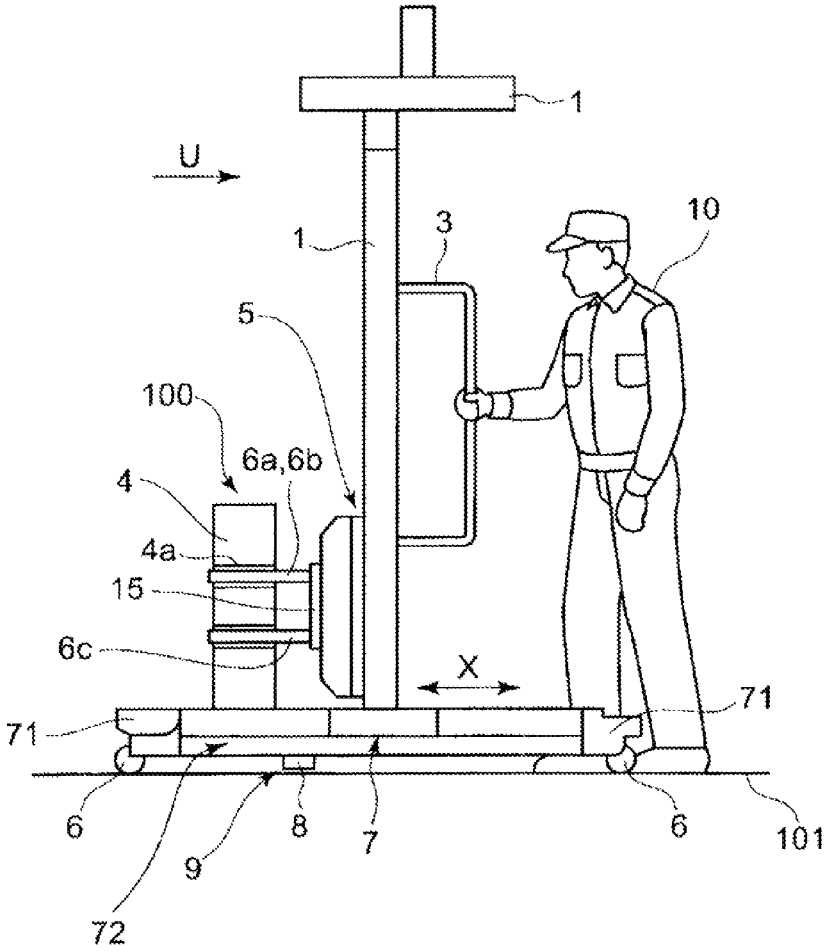
FIG. 1 is a schematic side view of a transferring apparatus for a heavy object cassette in an embodiment of the present invention.
Figure 2:
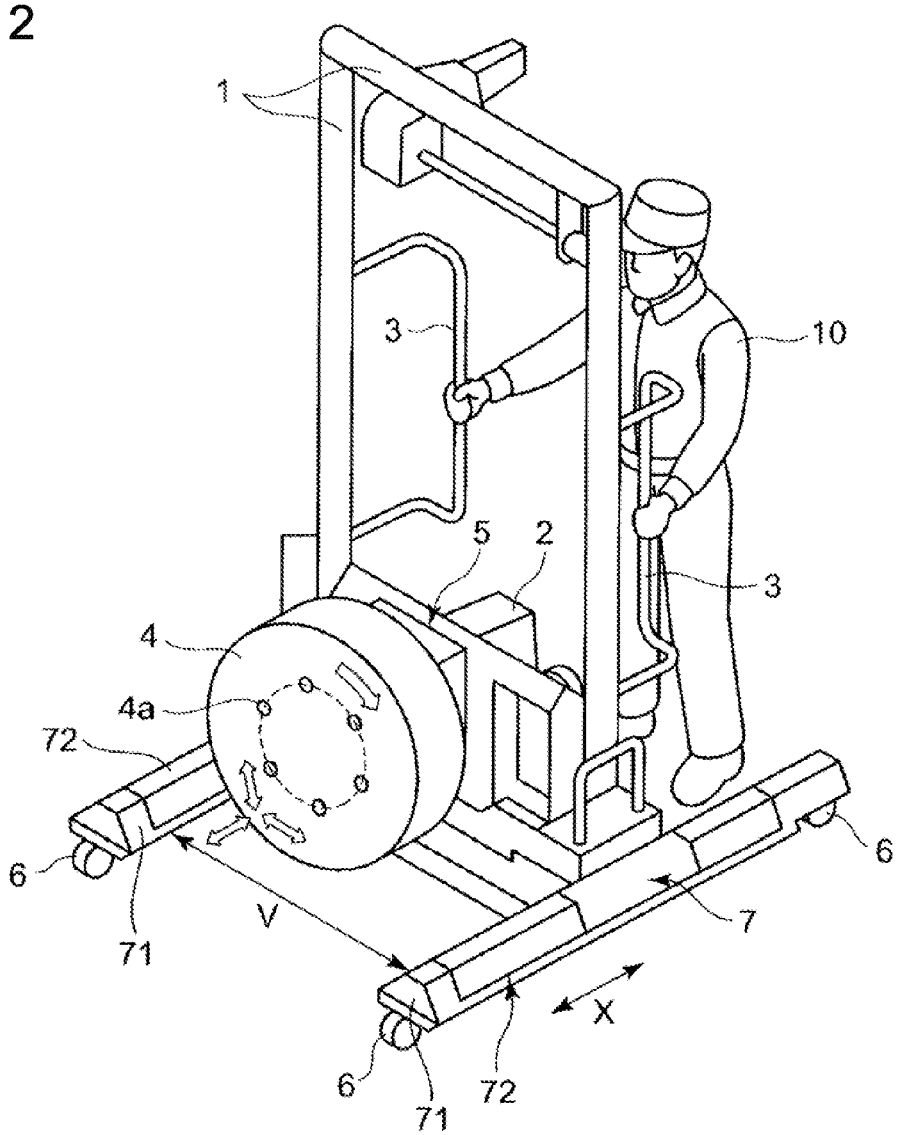
FIG. 2 is an oblique view of the embodiment taken from a direction of an arrow U of FIG. 1.

FIG. 1 is a schematic side view of a transferring apparatus for a heavy object cassette in an embodiment of the present invention. FIG. 2 is an oblique view of the embodiment taken from a direction of an arrow U of FIG. 1.

In FIG. 1 and FIG. 2, the transferring apparatus for the heavy object cassette 100 is configured as described below.

The heavy object cassette 4 is a cassette containing one heavy object therein. After completing a winding process of winding a belt-shaped material (not shown) around a drum-like member, the heavy object cassette 4 is placed on a placement table of a winding device. FIG. 1 shows the heavy object cassette 4 supported by the transferring apparatus 4 to remove the heavy object cassette 4 on the placement table from the placement table and then to place it on a transporting wagon.

A base unit 7 is provided with a gate-type support (main body) 1 which is formed into a gate shape and is installed on the base unit 7. The gate-type support 1 is provided with handles 3 on both sides of the gate-type support 1 for an operator 10 to hold onto. On a front side of the gate-type support 1, a lifting and lowering device 5 equipped with a play mechanism 51 (see FIG. 3) is installed.

Further, the base unit 7 is configured manually movable with respect to a main body 71 of the transferring apparatus by the operator 10 in a direction of an arrow X via a sliding mechanism 72. Furthermore, the main body 71 of the transferring apparatus has two pairs of two wheels provided parallel to each other on left and right sides, the two pairs being arranged on front and rear sides of the main body 71. The slide mechanism 72 is provided with a stopper mechanism (not shown) for keeping the sliding mechanism 72 from sliding. By locking the slide mechanism 72 by means of the stopper mechanism, the transferring apparatus 100 for the heavy object cassette can be manually moved via the wheels 6 by the operator 10 pushing and pulling the transferring apparatus 100 by the handles 3.

The lifting and lowering device 5 is driven by an electric motor (not shown) and is movable up and down along a longitudinal part of the gate-type support 1.

The lifting and lowering device 5 is arranged on the front part of the gate-type support 1. The front part of the gate-type support 1 is formed with such a width that the heavy object cassette 4 is fitted within and with such a space V that a placement table cart for the heavy object cassette 4 can enter the space V as shown in FIG. 2.

The heavy object cassette 4 is a cassette containing one heavy object therein. For instance, the heavy object cassette 4 is formed by winding a thin belt-like plate around a round drum-like member and weighs approximately 100 kg or more and, as shown in FIG. 2, has six holes 6*a* horizontally formed through the drum-like member. The number of holes 4*a* is not limited as long as there are more holes 4*a* than support rods 6*a*, 6*b*, 6*c*.

Figure 3A:
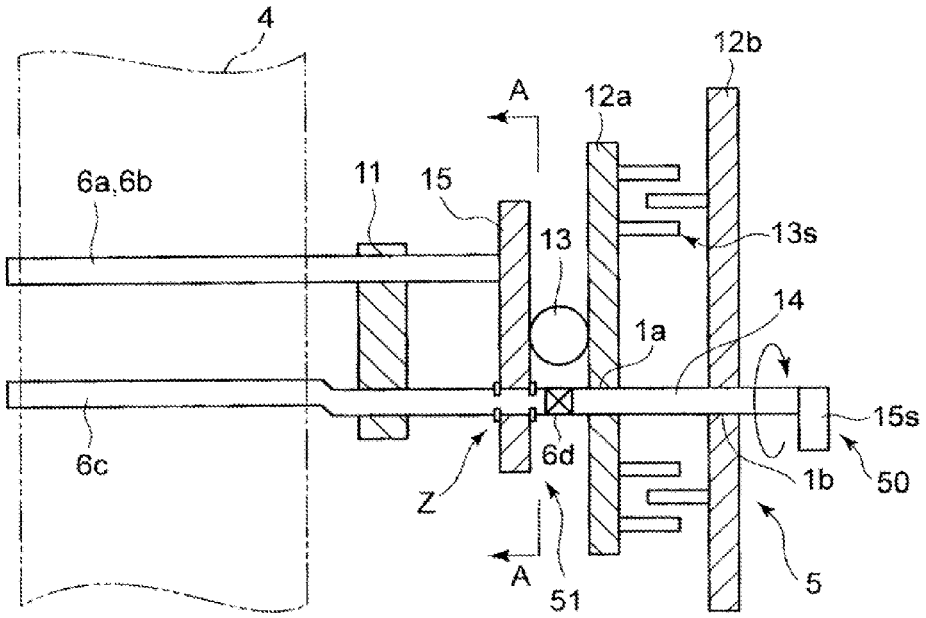
FIG. 3A shows a functional diagram of a play mechanism of FIG. 1.
Figure 3B:
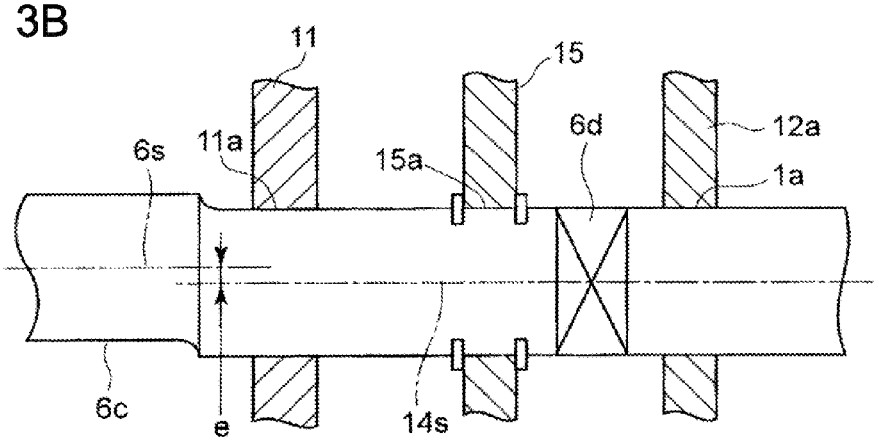
FIG. 3B is an enlarged view of a section Z of FIG. 3A.

FIG. 3A shows a functional diagram of a play mechanism of FIG. 1. FIG. 3B is an enlarged view of a section Z of FIG. 3A.

The lifting and lowering device 5 has a rear lateral part 12*b* which moves up and down along the gate-type support 1 and a front lateral part 12*a* which is arranged next to the rear lateral part 12*b* via a joint 13*s*.

Figure 4:
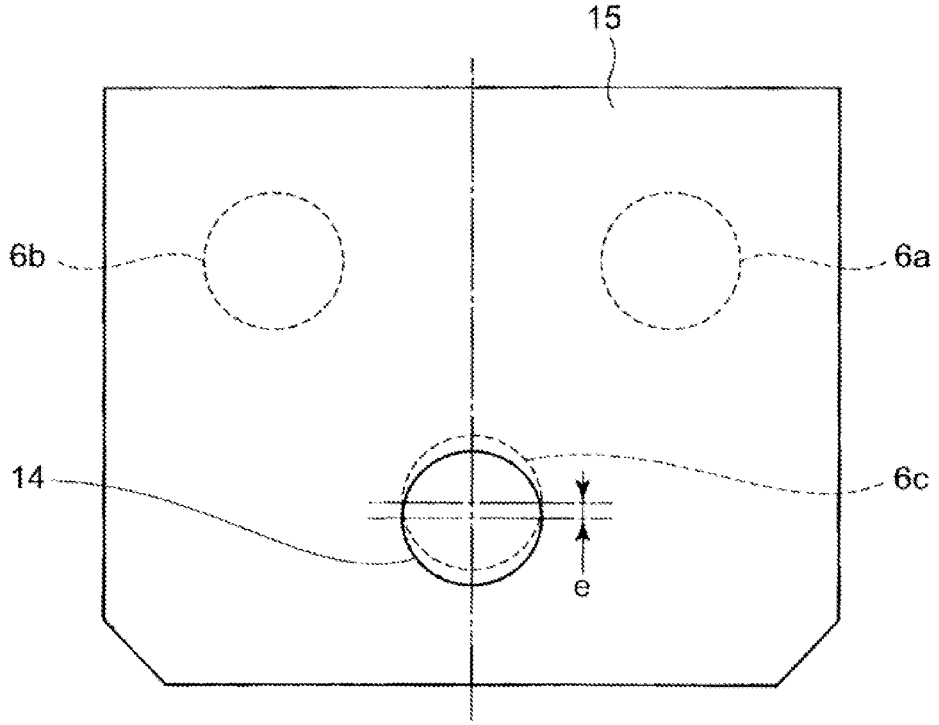
FIG. 4 is a view taken along a line A-A of FIG. 3A.

On the front part of the lifting and lowering device 5, two support rods 6*a*, 6*b* and one eccentric support rod 6*c* are attached to a common steel plate (a plate member) 15 at equal intervals in a circumferential direction as shown in FIG. 4. The support rods 6*a*, 6*b*, 6*c* are insertable in six holes 4*a* formed in the heavy object cassette 4.

Those two support rods 6*a*, 6*b* are fixed to a front part of the steel plate 15, i.e. a support side. The eccentric support rod 6*c* penetrates the steel plate 15 and extends rearward as shown in FIG. 3A and FIG. 3B. Those three support rods 6*a*, 6*b*, 6*c* penetrate a securing plate 11 arranged on a front side of the steel plate 15 so as to improve support stiffness.

As shown in FIG. 3B, the eccentric support rod 6*c* is supported rotatably by the steel plate 15 and the securing plate 11 at a front end part (support points 15*a*, 11*a*) and at a rear end part, penetrates the front lateral part 12*a* and the rear lateral part 12*b* (support points 1*a*, 1*b*) and extends rearward.

On a front side of the securing plate 11, a center 6*s* of the eccentric support rod 6*c* is eccentrically displaced with a certain amount of eccentricity "e" from a center 14*s*. At an end of the eccentric support rod 6*c*, a handle 15*s* is provided to rotate the eccentric support rod 6*c*. The eccentric support rod 6*c* is inserted through and supported rotatably by the steel plate 15 and also secured by a bush to prevent the eccentric support rod 6*c* from moving in an axial direction. In this manner, the cassette immobilizing mechanism 50 is formed by the eccentric support rod 6*c* and the handle 15*s* for rotating the eccentric support rod 6*c*.

The steel plate 15 is supported rotatably and swingably via a ball joint 13 arranged rollable between the steel plate 15 and the front lateral part 12*a*. The range of rotation and swing is restricted by the steel plate 15 contacting another member. Further, to allow the eccentric support rod 6*c* to accommodate the rotating and swinging motion of the steel plate 15, a universal joint mechanism 6*d* is installed between the steel plate 15 and the front lateral part 12*a*. In this manner, the play mechanism 51 is configured such that the steel plate 15 is supported and is movable in the rotation direction and the up-down and left-right directions with respect to the front lateral part 12*a*.

Therefore, in response to the movement of the steel plate 15 such as rotating and swinging thereof, a direction and a position of the support rods 6*a*, 6*b* fixed to the steel plate 15 and the eccentric support rod 6*c* penetrating the steel plate 15 as a whole can be freely adjusted without changing a position relationship between the support rods 6*a*, 6*b* and the eccentric support rod 6*c*.

Alternatively, instead of the universal joint mechanism 6*d*, holes in the steel plate 15 may be formed slightly bigger than the diameter of the eccentric support rod 6*c* so as to accommodate the swinging motion of steel plate 15.

Further, between the front lateral part 12*a* and the rear lateral part 12*b*, a joint 13*s* may be provided slidably in a front-back direction to absorb a displacement between the gate-type support 1 and the lifting and lowering device 5 in the front-back direction.

Figure 5:
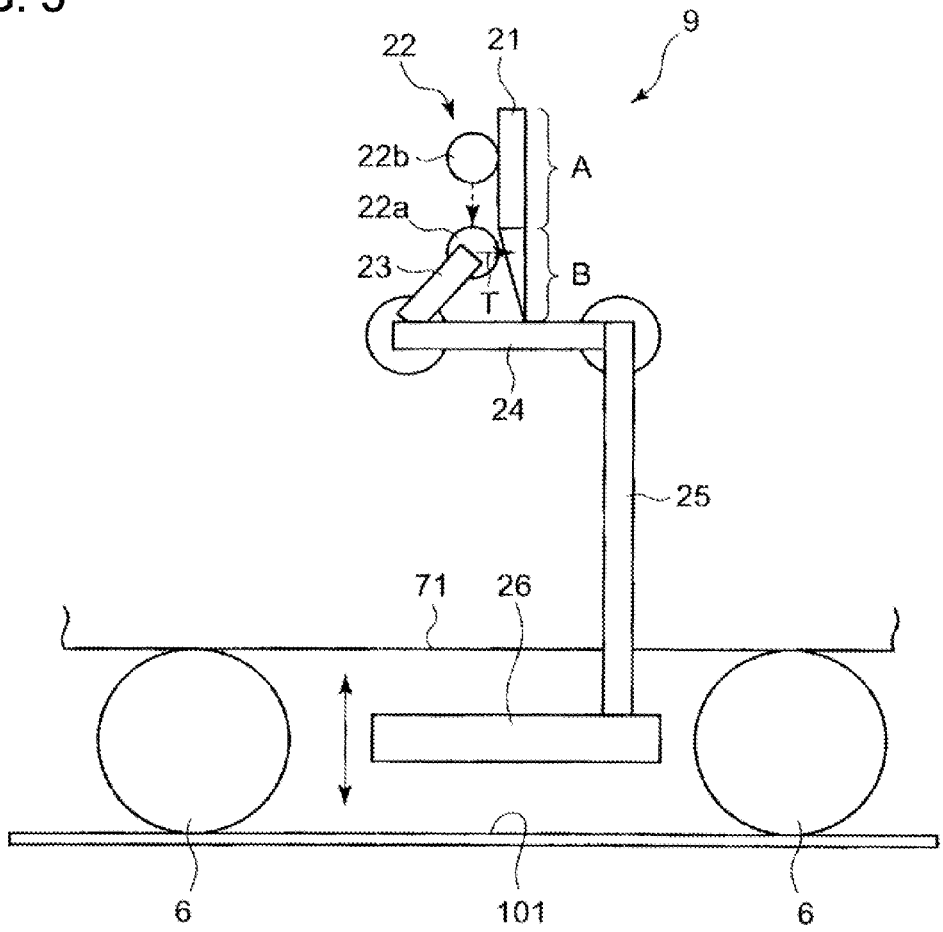
FIG. 5 shows a functional diagram of a locking mechanism of FIG. 1.
Figure 6A:
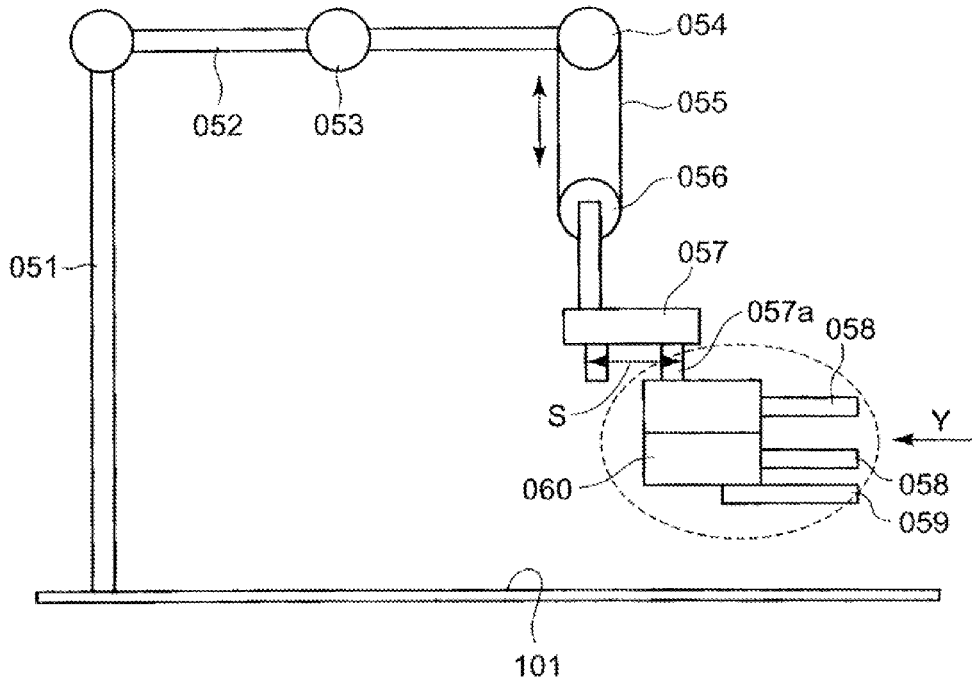
FIG. 6A Related Art
FIG. 6A is a schematic side view of a transferring apparatus for a heavy object cassette in relation to related art.
Figure 6B:
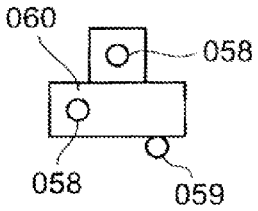
FIG. 6B Related Art
FIG. 6B is an enlarged view of a carrying unit section of FIG. 6A.

FIG. 5 shows a functional diagram of the locking mechanism 9 of FIG. 1.

A rail 21 is arranged movable up and down in conjunction with the lifting and lowering device 5 moving up and down along the gate-type support 1. The rail 21 includes a parallel part A and an oblique part B. A roller 22 is supported by the main body 71 of the transferring apparatus via a link mechanism and moves up and down along the rail 21.

When the roller 22 is at a point 22*a* of the rail 21, the roller 22 moves in a direction of an arrow T at the oblique part B, thereby causing a connecting link 23, 24, 25 to move downward. This causes the brake 26 to contact the ground 101, thereby braking the main body 71 of the transferring apparatus.

When the roller 22 is at a point 22*b*, the roller 22 is along the parallel part A, thereby causing the connecting link 23, 24, 25 to move upward. This causes the brake 26 to be lifted from the ground 101, thereby releasing the brake.

The connecting link 23, 24, 25 is supported on the main body side 71 and the roller 22 is arranged approximately in the center of the main body 71 of the transferring apparatus in the longitudinal direction. When the lifting and lowering device 5 provided with the rail 21 is approximately in the center of the main body 71 of the transferring apparatus and is at a prescribed height or lower, the roller 22 is at the parallel part A, thereby causing the connection link 23, 24, 25 to move upward, and releasing the brake 26. This causes the main body 71 of the transferring apparatus movable using the wheels 6.

Further, when the lifting and lowering device 5 is not in the central position or when the lifting and lowering device 5 is at the prescribed height or higher, the roller 22 is at the oblique part B or is not engaged with the rail 21. This causes the brake 26 to come down and to contact the ground 101, thereby applying the brake. As a result, the main body 71 of the transferring apparatus is locked.

More specifically, in the process of inserting the support rods 6*a*, 6*c* in the holes 4*a* of the heavy object cassette 4 or in the process of removing the heavy object cassette 4 from the placement table, the brake is applied to the main body 71 of the transferring apparatus. Thus, the process of inserting the support rods 6*a*, 6*c* in the holes 4*a* of the heavy object cassette 4 as well as the process of removing the heavy object cassette 4 from the placement table can be performed in a steady manner, positively and fast.

The advantages and effects of the embodiment are now described.

To fit the space V at the front part of the gate-type support 1 in a position of the placement cart for the heavy object cassette 4, the main body 71 of the transferring apparatus is moved via the wheels 6. Once arriving at a position to transfer the heavy object cassette 4, the base unit 7 is manually moved by the operator 10 frontward in FIG. 1 via the slide mechanism 72 and the lifting and lowering device 5 is set at an appropriate position above using the electric motor. In this process, the brake is applied to the main body 71 of the transferring apparatus using the locking mechanism 9.

By advancing the lifting and lowering device 5 frontward via the base unit 7, the support rods 6*a* and 6*b* and the eccentric support rod 6*c* can be inserted in the corresponding three holes 4*a* among the six holes 4*a* formed horizontally in the heavy object cassette 4.

In the insertion process, the position relationship of the support rods 6*a*, 6*b*, 6*c* fixed to the steel plate 15 is matched in advance with the position relationship of the holes 4*a* formed in the heavy object cassette 4, and by adjusting the position of the steel plate 15 in the rotation direction and the up-down and left-right directions by the play mechanism 51, and further by moving the base unit 7 freely frontward and rearward via the slide mechanism 72, the direction and the position of the support rod 6*a*, 6*b* and the eccentric support rod 6*c* as a whole can be freely adjusted and thus, it is possible to finely adjust a space between the holes and the support rods and also to easily insert the support rods 6*a*, 6*b*, 6*c* in the holes 4*a*.

The eccentric support rod 6*c* is supported rotatably by the rigid steel plate 15 at the support point 15*a* and the rear end part is supported rotatably by the lateral parts 12*a*, 12*b* at the support points 1*a*, 1*b*. In the front end portion of the eccentric support rod 6*c*, the center 6*s* of the eccentric support rod 6*c* is eccentric with respect to the center 14*s* of the support point with a certain amount of eccentricity "e" and thus, by turning the handle 15*s* provided at the end of the eccentric support rod 6*c* to change the direction of the eccentricity "e" as shown in FIG. 4, i.e. by changing the position of the eccentric support rod 6*c* in the radial direction, the relative position of the support rods changes relative to the relative position of the holes formed in the heavy object cassette 4. By this, the heavy object cassette 4 is grabbed by the support rods or held firmly by the support rods 6*a*, 6*c* in the case of expanding the relative position among the support rods.

The one support rod disposed in the lowest position among the three support rods disposed circumferentially, is the eccentric support rod 6*c*. Thus, the two support rods 6*a*, 6*b* disposed above the eccentric support rod 6*c* are used to lift the heavy object cassette 4 and no support load is acting on the lowest support rod disposed in the lowest position and thus, the lowest support rod can be turned with small turning force compared to the other support rods disposed above the lowest support rod. Therefore, by forming the eccentric support rod 6*c* by the lowest support rod, the heavy object cassette can be immobilized by an easy operation.

According to the embodiment, the lifting and lowering device 5 including the play mechanism 51 and the base unit 7 having the gate-type support 1 installed thereon for supporting the lifting and lowering device 5 are manually movable by the operator 10 in the X direction of FIG. 1 with respect to the main body 71 of the transferring apparatus. By this, the overall length of the transferring apparatus for the heavy object cassette can be shorter, thereby reducing the transferring apparatus in size.

More specifically, the gate-type support 1 is moved to an anterior end position via the slide mechanism 72 to grab and hold the heavy object cassette 4 and then, the base unit 7 is moved to the center part of the main body 71 of the transferring apparatus via the slide mechanism 72 to balance and thus, the main body 71 of the transferring apparatus can be moved via the wheels 6 with a steady balance. Therefore, the transferring apparatus can be moved in a steady and safe manner and the heavy object cassette 4 can be transferred in a steady manner with balance without increasing the overall length of the transferring apparatus 100. By this, it is also possible to reduce the size of the transferring apparatus as well as its overall lengths.

The weight of the heavy object cassette 4 is supported by the three support rods 6*a*, 6*b*, 6*c* fixed horizontally to the rigid steel plate 15 and, by moving the common steel plate 15 in the rotation direction and the up-down and left-right directions using the play mechanism 51 and the slide mechanism 72, the gap between the three support rods 6*a*, 6*b*, 6*c* and the horizontal holes 4*a* respectively is adjusted. Therefore, without using a conventional wire winch, the heavy object cassette 4 can be mechanically supported directly and transferred horizontally and thus, the transferring speed and the efficiency are improved. Further, the transferring apparatus is of a mechanical type and thus, there is no issue such as oil leaks.

Further, according to the embodiment, the lifting and lowering device 5 supported by the gate-type support 1 is off the central position of the main body 71 of the transferring apparatus, or when the lifting and lowering device 5 is at a prescribed height or higher, the brake 26 lowers and is pressed against the ground 101 to apply the brake, thereby locking the main body 71 of the transferring apparatus so as not to be able to move. Thus, in the process of inserting the support rods 6*a*, 6*b*, 6*c* in the holes 4*a* of the heavy object cassette 4, the heavy object cassette can be removed from the placement table in a steady manner and the operation can be performed firmly and promptly.

In the above structure, it is most practical to fix three support rods 6*a*, 6*b*, 6*c* to the common rigid steel plate 15, one of which is the eccentric support rod 6*c* which penetrates the steel plate 15 and is formed with the eccentricity "e". However, this is not limitative and three or more support rods may be provided while one eccentric support rod is provided.

In the above embodiment, by performing the following steps in the order:

inserting the plurality of support rods fixed to the common plate member in the plurality of holes formed in the heavy object cassette;

in the inserting step, adjusting the gap between the holes and the support rods by adjusting the position of the plate member;

immobilizing the support rods having been inserted in the holes, with respect to the plurality of holes; and after the immobilizing step, moving the heavy object cassette using the slide mechanism, it is possible to achieve the effects listed below.

Specifically, by performing the inserting step, the adjusting step, the immobilizing step and the moving step continuously, it is possible to transfer the heavy object cassettes 4 effectively.

Further, in the immobilizing step, one support rod 6*c* connected to the steel plate 15 is an eccentric support rod and, the eccentric support rod 6*c* is moved in the radial direction thereof by turning the eccentric support rod 6*c* so as to displace the relative position between the eccentric support rod 6*c* and other support rods 6*a*. Thus, the heavy object cassette 4 is firmly and easily immobilized with respect to the support rods 6*a*, 6*c* and the subsequent step of transferring the heavy object cassette 4 can be performed easily.

When the heavy object cassette 4 is removed from the placement table for the heavy object cassette using the slide mechanism 72, the brake is applied to the main body 71 of the transferring apparatus using the locking mechanism 9. Thus, the step of inserting the support rods in the holes of the heavy object cassette can be performed positively and promptly.

INDUSTRIAL APPLICABILITY

According to the present invention, it is possible to provide the transferring apparatus for the heavy object cassette as well as the transferring method for the heavy object cassette, which is entirely mechanically operable without using hydraulic pressure, by which it is easy to load and unload the heavy object cassette, and which operates at high speed.

The invention claimed is:

1. A transferring apparatus for a heavy object cassette, comprising:

a common plate member to which a plurality of support rods is attached on a support side of the plurality of support rods, the plurality of support rods being inserted in a plurality of holes formed in the heavy object cassette;

a play mechanism which allows adjustment of a relative position between the plurality of holes and the plurality of support rods by adjusting a position of the common plate member, the play mechanism including a ball joint which is configured to support the common plate member rotatably and swingably;

a lifting and lowering device configured to lift and lower the common plate member to which the support rods are attached and the play mechanism;

a base unit on which the lifting and lowering device is installed; and a slide mechanism configured to support the base unit, the slide mechanism being movable forward and backward relative to a main body of the transferring apparatus.

2. The transferring apparatus for the heavy object cassette according to claim 1, wherein at least one of the plurality of support rods is an eccentric support rod configured to penetrate the common plate member and having an eccentric part with a certain amount of eccentricity with respect to the common plate member, and wherein the transferring apparatus further comprises:

a cassette immobilizing mechanism configured to immobilize the heavy object cassette by rotating the eccentric part of the eccentric support rod to move the eccentric support rod in a radial direction and changing a relative position between the eccentric support rod and another one of the plurality of support rods.

3. The transferring apparatus for the heavy object cassette according to claim 2, wherein the eccentric support rod is disposed below the other one of the plurality of support rods.

4. The transferring apparatus for the heavy object cassette according to claim 1, further comprising:

a locking mechanism configured to activate a brake on the main body of the transferring apparatus in a state in which a gate-type support is moved from a center part of the main body of the transferring apparatus by the slide mechanism.

5. The transferring apparatus for the heavy object cassette according to claim 4, wherein the locking mechanism is configured to be activated in a state in which the lifting and lowering device lifts the gate-type support by a certain amount or more.

6. A method for transferring a heavy object cassette using a heavy object cassette transferring apparatus which transfers the heavy object cassette by a rolling motion of a wheel while maintaining the heavy object cassette via a plurality of support rods inserted in a plurality of holes formed in the heavy object cassette, the method comprising the steps of:

inserting the plurality of support rods which is fixed to a common plate member in the plurality of holes formed in the heavy object cassette;

in the inserting step, adjusting a relative position between the plurality of holes and the plurality of support rods by adjusting a position of the common plate member;

immobilizing the plurality of support rods, at least one of the support rods being an eccentric support rod which penetrates the common plate member and has an eccentric part with a certain amount of eccentricity on a front side of the common plate member, by rotating so that the eccentric support rod is moved in a radial direction of the eccentric support rod to displace a relative position between the eccentric support rod and another one of the plurality of support rods, and after the immobilizing step, moving the heavy object cassette using a slide mechanism.

7. The method for transferring the heavy object cassette according to claim 6, wherein a brake is applied to a main body of the transferring apparatus when the plurality of support rods is inserted in the plurality of holes of the heavy object cassette using the slide mechanism or when the heavy object cassette is removed from a placement table for the heavy object cassette using the slide mechanism.

* * * * *